US007145529B2

(12) United States Patent
Vulto et al.

(10) Patent No.: US 7,145,529 B2
(45) Date of Patent: Dec. 5, 2006

(54) METHOD AND DRIVE MEANS FOR COLOR CORRECTION IN AN ORGANIC ELECTROLUMINESCENT DEVICE

(75) Inventors: Simone Irene Elisabeth Vulto, Eindhoven (NL); Coen Theodorus Hubertus Fransiscus Liedenbaum, Eindhoven (NL)

(73) Assignee: Koninklijke Philips Electronics, N.V., Eindhoven (NL)

( * ) Notice: Subject to any disclaimer, the term of this patent is extended or adjusted under 35 U.S.C. 154(b) by 464 days.

(21) Appl. No.: 10/487,207

(22) PCT Filed: Aug. 22, 2002

(86) PCT No.: PCT/IB02/03377

§ 371 (c)(1),
(2), (4) Date: Feb. 18, 2004

(87) PCT Pub. No.: WO03/019510

PCT Pub. Date: Mar. 6, 2003

(65) Prior Publication Data

US 2004/0239595 A1 Dec. 2, 2004

(30) Foreign Application Priority Data

Aug. 23, 2001 (EP) ..... 01203178

(51) Int. Cl.
*G09G 3/30* (2006.01)

(52) U.S. Cl. ..... 345/76; 345/77; 345/84

(58) Field of Classification Search ..... 345/74–78, 345/60, 80, 82–84, 204, 206, 291
See application file for complete search history.

(56) References Cited

U.S. PATENT DOCUMENTS

| | | | | |
|---|---|---|---|---|
| 6,501,230 | B1 * | 12/2002 | Feldman | 315/169.3 |
| 6,617,184 | B1 * | 9/2003 | Bohler et al. | 438/22 |
| 2003/0010892 | A1 * | 1/2003 | Clark | 250/208.1 |
| 2003/0053044 | A1 * | 3/2003 | Popovic et al. | 356/218 |
| 2004/0021423 | A1 * | 2/2004 | Jongman et al. | 315/169.1 |

FOREIGN PATENT DOCUMENTS

WO WO9945525 9/1999

* cited by examiner

*Primary Examiner*—Richard Hjerpe
*Assistant Examiner*—Mansour M. Said

(57) ABSTRACT

This invention relates to a method for color correction in an organic electroluminescent device (1), having at least one pixel (6), comprising an electro-luminescent material layer (5), which is sandwiched between a first and a second electrode (2, 3), and constituting at least a first and a second light-emitting element (6R,6G), wherein said method comprises the steps of: inputting a data signal (S) comprising information to be displayed by said light-emitting elements (6R,6G), generating, in a correction means (10), a correction factor for each light-emitting element (6R, 6G), said correction factor being based on a relationship between a color point wavelength shift ($\Delta\lambda$) and a measured shift in one of a voltage across at least one of said light-emitting elements (6R,6G) at a predetermined current ($I_s$) and a current through at least one of said light-emitting elements (6R,6G), at a predetermined voltage ($V_s$), applying said correction factor on said data signal (S), and supplying the corrected data signal (S) to the light-emitting elements (6R, 6G).

Figure 1A:
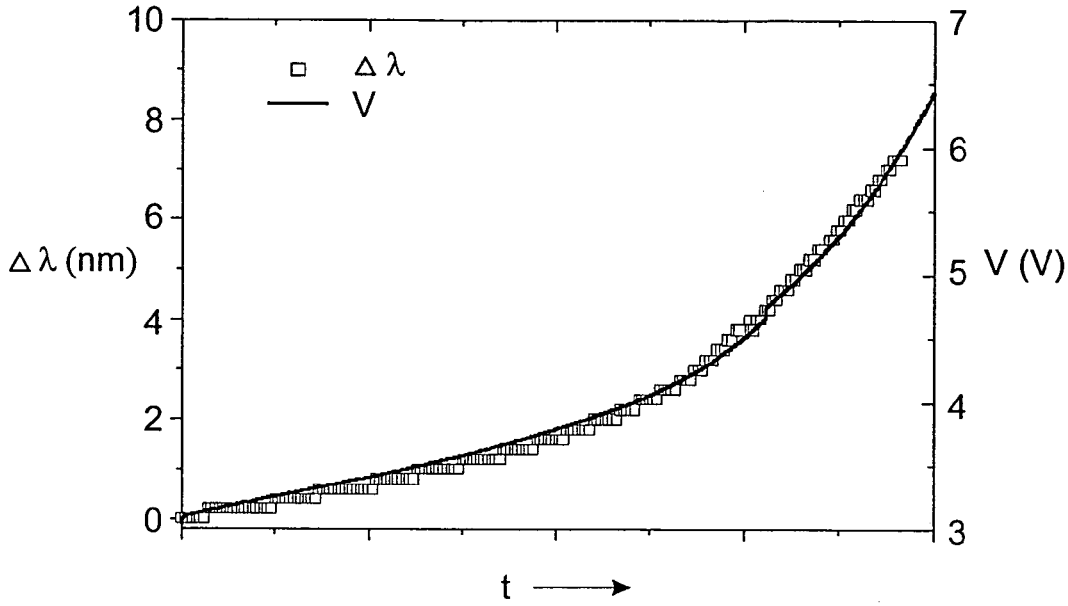

The invention also relates to a drive means implementing the above-described method.

11 Claims, 2 Drawing Sheets

METHOD AND DRIVE MEANS FOR COLOR CORRECTION IN AN ORGANIC ELECTROLUMINESCENT DEVICE

The present invention relates to a method for color correction in an organic electroluminescent device, having at least one pixel, comprising an electroluminescent material layer, which is sandwiched between a first and a second electrode, the pixel constituting at least a first and a second light-emitting element.

The invention also relates to a drive means for an organic electroluminescent device, comprising a layer of electroluminescent material, which is sandwiched between a first and a second electrode pattern, wherein said patterns define at least one pixel, each comprising at least a first and a second light-emitting element, said drive means being connected to said electrodes and arranged to apply electrical power to said electroluminescent material in order to achieve light emission from said material.

The technology of organic electroluminescent light-emitting diodes, such as polymer light-emitting diodes (polyLED or PLED) or organic light-emitting diodes (OLED), is a fairly recently discovered technology that is based on the fact that certain organic materials, such as polymers, may be used as a semiconductor in a light-emitting diode. This technology is very interesting due to the fact that, for example, polymers as materials are light, flexible and inexpensive to produce. Consequently, polyLEDs and OLEDs provide the opportunity to create thin and highly flexible displays, for example for use as electronic newspapers or the like. Further applications of these displays may be, for example, displays for cellular telephones.

The above-described displays have a plurality of advantageous features as compared with competing technologies, such as LCD displays. To start with, electroluminescent organic displays are very efficient in the generation of light, and the luminous efficiency may be more than 3 times higher for a polyLED display than a LCD display. As a consequence, the polyLED display may be run three times longer on the same battery. Furthermore, the electroluminescent organic displays have benefits regarding contrast and brightness. PolyLED displays are, for example, not dependent upon the viewing angle, since light is transmitted in all directions with the same intensity.

The organic electroluminescent device technology has, however, now advanced to a point where full color displays using this technology are indeed to be considered as an option. In order to obtain primary colors, several methods may be used.

One straightforward approach is by creating colors, using white light combined with color filters, as in for example TFT-LCD displays. A great disadvantage of this approach is, however, that the use of color filters adds complexity and cost to the cell, and furthermore, ⅔ of the available spectrum transmitted from a white light source is absorbed by the color filter, making this approach quite energy inefficient.

However, for organic electroluminescent devices, another possible approach to create colors is to tune the basic emissive material in such a way that the values of the CIE color coordinates x and y coincide with the required color points for red, green and blue. This may be done for low molecular weight devices, such as OLED devices by tuning the dopant in the host material. For polymer applications, such as PLED, changes in the spectrum may be achieved by modifying the main and side chain constituents of the polymer material. It is also possible to add dopants to the polymer material. Due to the fact that light-emitting polymer materials are available for the colors red (R), green (G) and blue (B), a color display may be obtained simply by applying R, G and B material at appropriate positions in pixels of an array structure, containing a plurality of pixels. This may be achieved by prior art printing technologies.

There is, however, a great problem with the above approach to generate colors. This is due to the fact that said x and y CIE color coordinates in real applications are dependent upon the total time during which a pixel is driven. This effect is present for essentially all organic luminescent materials, regardless of color. During the lifetime of the display, the emission spectrum of the electroluminescent material, and consequently the CIE color point, shifts in time. Consequently, although much effort is put in obtaining correct and specific CIE color coordinate values for the R, G and B points, their position will change as soon as the pixels have been driven for a certain time. Furthermore, since all pixels are not driven equally long, the above-described "ageing" process will be different for different pixels of the display. Moreover, this is especially important for full color applications, since all the colors have not been driven for the same time, and each color shows a similar, but not identical spectral degradation behaviour.

One approach to solve this problem is described in patent document WO-9945525. The described construction concerns a matrix of pixels comprising three monochrome electroluminescent diodes (R, G, B). The diodes are controlled by a circuit delivering a power P to each diode, wherein the power is determined by P=k*Pr, where Pr is a reference power particular to the diodes of each color, and k is a coefficient selected according to the display to be presented. Furthermore, in the course of time, the reference power is subjected to variations in order to compensate for the ageing of the diodes. However, this system has a major disadvantage in that the total time each diode of the display has been on has to be stored in a memory device, and the achieved compensation is dependent upon this information. Consequently, this system needs a large memory space, making it somewhat impractical to realize. Furthermore, this system needs to be continuously activated, in order to keep track of said total time.

Consequently, an object of the present invention is to provide a further improved method and a device, for which the above-described problems are reduced. The invention is defined by the independent claims. The dependent claims define advantageous embodiments.

These and other objects are achieved by a method as described in the opening paragraph, the method comprising the steps of inputting a data signal comprising information to be displayed by said light-emitting element, generating, in a correction means, a correction factor for each light-emitting element, said correction factors being based on:

(i) a measured shift in a voltage across a light-emitting element at a predetermined current ($I_s$) through said light-emitting element and a relation between the shift in the voltage and a color point wavelength shift ($\Delta\lambda$) of said light-emitting element, or (ii) a measured shift in a current through a light-emitting element at a predetermined voltage ($V_s$) across said light-emitting element and a relation between the shift in the current and a color point wavelength shift ($\Delta\lambda$) of said light-emitting element, and outputting from said correction means said correction factor, to be applied on said data signal. This method is advantageous in that a color correction may easily be obtained at any time during the drive of the device, since the total color point may be adjusted by adjusting the voltage across, or the current through, individual light-emitting elements in a suitable fashion. Furthermore, the voltage across and the current through a display are easy to measure, resulting in a method that is easy and cost-efficient to implement.

If required, said correction factors may be based on measurements performed on more than one light-emitting element in the pixel, preferably on each light-emitting element in the pixel. The relation between the measured shift in voltage or current and the color point may be different for different light-emitting elements.

Preferably, said correction means comprises a look-up table containing pre-measured related information regarding voltage applied across a light-emitting element, current applied through said light-emitting element, and induced wavelength shift of said light-emitting element. By storing such information, which may be integrated and not necessarily clearly expressed, in a look-up table, this information is easily accessible.

In accordance with a preferred embodiment, the method comprises the steps of feeding, with predetermined time intervals, one of said light-emitting elements with a predetermined current, measuring the voltage across the light-emitting element as the current is fed through the light-emitting element, calculating a voltage shift between said measured voltage and a previous voltage for a corresponding current, inputting said voltage shift to said correction means, and outputting from said correction means a correction factor corresponding to a wavelength shift $\Delta\lambda$ of said light-emitting element, based on said voltage shift. This allows a simple correction by only measuring the voltage across the device when a determined current is applied through it. Preferably, the wavelength shift ($\Delta\lambda$) for a light-emitting element is calculated by:

$$\Delta\lambda = k \cdot \Delta V$$

where $\Delta\lambda$ is the obtained wavelength shift, k is a correction coefficient and $\Delta V$ is the voltage shift, wherein k is a value being pre-stored in said correction means for each light-emitting element or for each type of light-emitting element. The correction coefficient could be either a constant or a function of the voltage across and/or the current through the display, i.e. k=k(V,I). Using such organic electroluminescent materials, which have a linear relationship between the voltage shift and the wavelength shift, allows the use of a very small look-up table, since in practice only the correction coefficient needs to be stored. This is advantageous, since such a table requires little memory space and is easily attainable. Moreover, the same correction coefficient k can be used for light-emitting elements of the same type. "Light-emitting elements of the same type" are understood to mean light-emitting elements having the same composition and dimensions of the light-emitting layer and having the same composition and dimensions of the first and the second electrode. For example, for a full color matrix display having red-emitting, green-emitting and blue-emitting elements, wherein all light-emitting elements of a color (red, green or blue) are of the same type, only three correction coefficients k need to be stored.

In accordance with a variant of this embodiment, said previous voltage is an initial voltage across said light-emitting element, measured during manufacture of the device. All measured values are compared with the same pre-stored value, resulting in a stable system. In accordance with another variant of this embodiment, said previous voltage is a voltage across said light-emitting element measured previously during the drive of the device, resulting in a device that does not require initial calibration.

In accordance with a second embodiment of this invention, the method comprises the steps of feeding, with predetermined time intervals, one of said light-emitting elements with a predetermined voltage, measuring the current through said light-emitting element as the voltage is applied across the light-emitting element, calculating a current shift between said measured current and a previous current, inputting said current shift to said correction means, and outputting from said correction means a correction factor corresponding to a wavelength shift $\Delta\lambda$ of said light-emitting element, based on said current shift. This also allows a simple correction by only measuring the current through the device when a predetermined voltage is applied across it. Preferably, the wavelength shift for said light-emitting element is calculated by:

$$\Delta\lambda = k \cdot \Delta I$$

where $\Delta\lambda$ is the obtained wavelength shift, k is a correction coefficient and $\Delta I$ is the current shift, wherein k is a value being pre-stored in said correction means for each light-emitting element or for each type of light-emitting element. The correction coefficient could be either a constant or a function of the voltage across and/or the current through the display, i.e. k=k(V,I). Using such organic electroluminescent materials, which have a linear relationship between the voltage shift and the wavelength shift, allows the use of a very small look-up table, since in practice only the correction coefficient k needs to be stored. This is advantageous, since such a table requires little memory space and is easily attainable. Moreover, the same correction coefficient k can be used for light-emitting elements of the same type. "Light-emitting elements of the same type" are understood to mean light-emitting elements having the same composition and dimensions of the light-emitting layer and having the same composition and dimensions of the first and the second electrode. For example, for a full color matrix display having red-emitting, green-emitting and blue-emitting elements, wherein all light-emitting elements of a color (red, green or blue) are of the same type, only three correction coefficients k need to be stored.

In accordance with a variant of this embodiment, said previous current is an initial current through said light-emitting element, measured during manufacture of the device. All measured values are compared with the same pre-stored value, resulting in a stable system. In accordance with another variant of this embodiment, said previous current is a current through said light-emitting element, measured previously during the drive of the device, resulting in a device that does not require initial calibration.

Preferably, said electroluminescent material is one of a polymer light-emitting material and an organic light-emitting material, which are well-tested materials that have advantageous properties. Furthermore, in accordance with a preferred embodiment, said at least one pixel suitably comprises three or more emitting elements, constituting sub-pixels of said pixel, for emission of different colors from said pixel, for example, for creating a traditional full color display, having red greed and blue light-emitting elements. Moreover, said correction factor is arranged to provide a constant total color point for the pixel, based on the light output from each of said light-emitting elements. "A constant total color point for the pixel" is understood to mean that the individual color points of the light-emitting elements may change in time due to ageing of the materials of said light-emitting elements, but that the light output of the total pixel constantly corresponds to the desired color point as defined by the data signal. A display having a constant color display behaviour, which is independent of the aging of the materials of the display, may be obtained.

The objects of this invention are also achieved by a drive means, as described in the opening paragraph, which is characterized in that said drive means comprises an input connection for inputting a data signal, comprising information to be displayed by each of said light-emitting elements, a correction means for applying a correction factor to said data signal, said correction factor being based on a relationship between a color point shift and a measured shift in one of a voltage across at least one of said light-emitting elements and a current through this light-emitting elements, and an output means for outputting said color-corrected data signal to said light-emitting elements. This device is advantageous in that a color correction may easily be obtained at any time during the drive of the device. Furthermore, the voltage across and the current through a display are easy to measure, resulting in a method that is easy and cost-efficient to implement. Preferably, said correction means comprises pre-measured related information regarding the voltage applied across a light-emitting element, the current applied through this light-emitting element, and induced wavelength shift of this light-emitting element. By storing such information, which may be integrated and not necessarily clearly expressed, in a look-up table, this information is easily accessible. Moreover, said correction factor is arranged to provide a substantially constant total color point for the pixel, based on the light output from each of said light-emitting elements. A display having a substantially constant color display behaviour, which is independent of the aging of the materials of the display, may be obtained.

These and other aspects of the invention will be apparent from and elucidated with reference to the embodiment described hereinafter.

A currently preferred embodiment of the present invention will now be described in closer detail, with reference to the accompanying drawings.

FIG. 1*a* is a schematic exemplifying diagram showing a wavelength shift as well as a voltage across an electroluminescent display as a function of the total drive time of said display, for a constant, given current through said display.

Figure 1B:
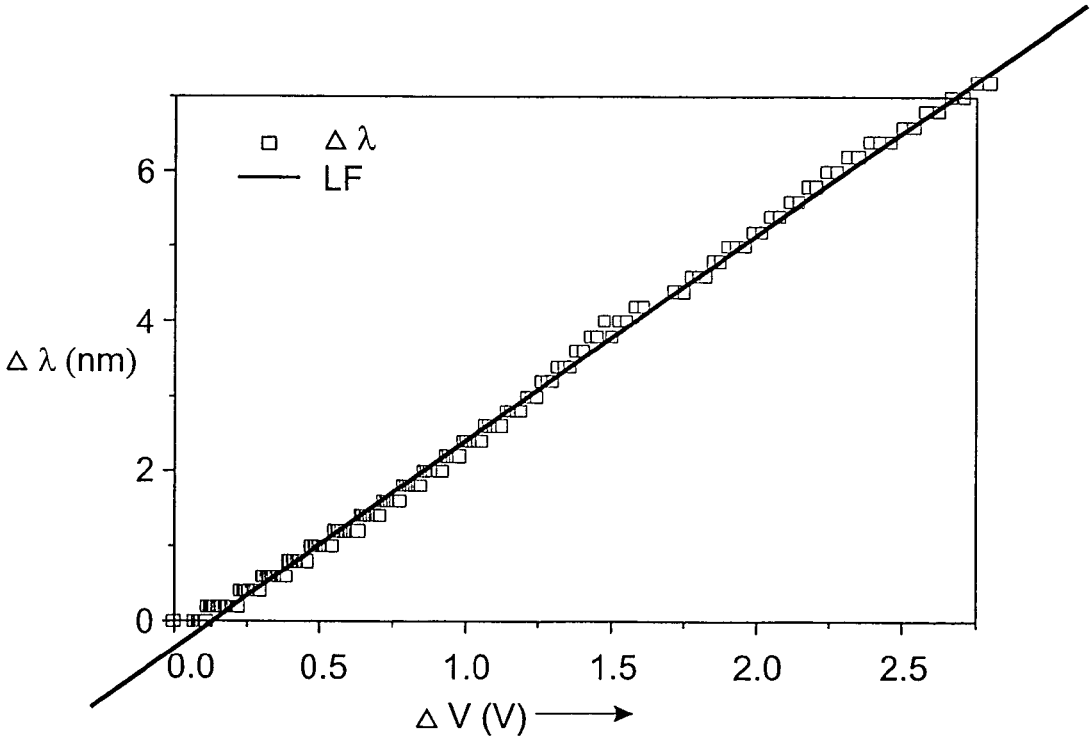

FIG. 1*b* is a schematic exemplifying diagram showing the relationship between the voltage shift and the wavelength shift in said electroluminescent display.

Figure 2:
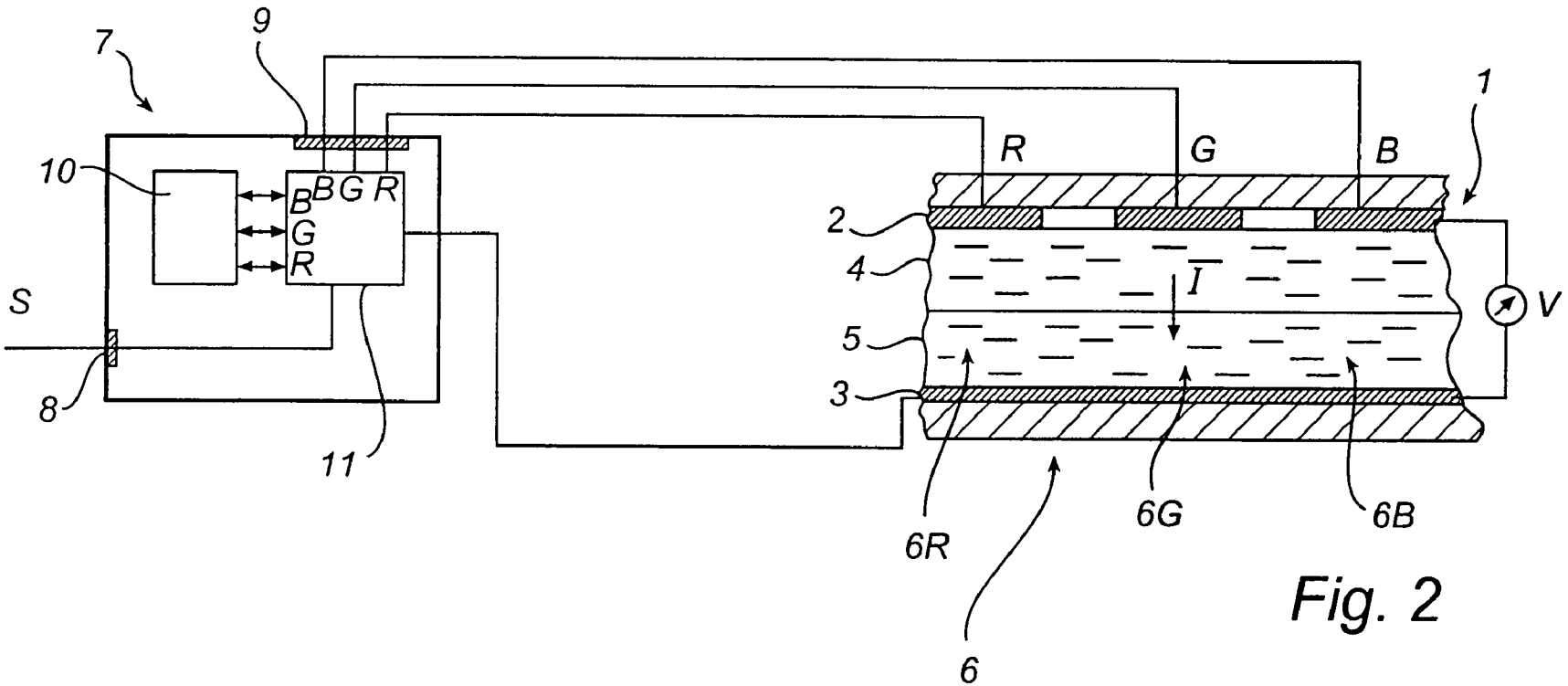

FIG. 2 is a schematic drawing showing one example of an electroluminescent display, in which a method and a device in accordance with the invention may be used.

FIG. 2 is a schematic drawing showing an electroluminescent display, in which a method and a device in accordance with the invention may be used.

The basic device structure of an electroluminescent display 1 comprises a structured first electrode 2 or anode, commonly of a transparent material such as ITO in order to be able to transmit light, a second electrode 3 or cathode and an emissive layer 5, which is sandwiched between the anode 2 and the cathode 3. In the example of the display shown in FIG. 2, a further conductive layer 4 such as a conductive polymer layer (for example, PEDOT) is sandwiched between said anode 2 and the emissive layer 5. Other layer structures are also possible, comprising fewer or more organic layers. Said emissive layer 5 may be, for example, be a polymer light-emitting material layer, for a PolyLED display, or an organic light-emitting material layer, for an OLED display.

During operation, a current I is fed between said anode and said cathode (schematically shown in the drawing), through the emissive electroluminent layer 5 in order to drive the material in said emissive electroluminent layer 5 to emission.

The example of the display shown in FIG. 2 comprises an array of pixels 6 (only one pixel shown) also referred to as light-emitting diodes (LEDs), which is defined by the electrodes 2, 3 and the interpositioned emissive layer 5. For full color applications, each pixel is further subdivided into three sub-pixels, or light-emitting elements 6R, 6G, 6B, containing electroluminent material for the emission of red, green and blue light, respectively. The pixel/sub-pixel pattern may be generated for example on a substrate by printing technology.

Furthermore, driving means 7 is connected to said electrodes 2, 3 for driving said display 1. For the above pixel/sub-pixel device, a driving means unit is arranged for each pixel 6, containing three sub pixels 6R, 6G, 6B.

Said driving means 7 comprises input means 8 for receiving a data signal S from an image generator (not shown). In the above case, the received data signal S contains information regarding a desired color or color point to be displayed by said pixel 6, by appropriately driving said sub-pixels (6R, 6G, 6B). Any color within a color triangle, having corners defined by the emission of R, G and B polymers (i.e. red, green or blue light-emitting polymers) is obtainable by a linear combination of R, G and B emission vectors, i.e. a combination of lighting the red, green and blue sub-pixels. Furthermore, each color point may be represented by a set of two coordinates x and y in a CIE chromaticity diagram. Said driving means 7 may include signal processing means 11 in which said color point information is transformed into driving information for each sub-pixel in order to generate a desired color for that specific pixel. However, this information division may also be contained in the input data signal S. Thereafter, driving information is applied to each of the emissive sub-pixels of the display via an output connection 9.

However, as described above, there is a problem with existing displays to maintain a correct color balance during the entire lifetime of the display, due to the fact that said color point changes, and this change is dependent upon the total driving time of that specific pixel or sub-pixel.

As suggested by this invention, the above-described driving means further comprises correction means 10 for storing a correction table, such as a look-up table and generating a correcting factor for the data signal S'. This correction means 10 is connected to said signal processing means 11.

This invention is based on the recognition that there is a relationship between a voltage (or current) alteration during the lifetime of an organic electroluminescent device, such as the above-described display, and a spectral shift of the emission during the lifetime of the device, when a pixel, or sub-pixel, is driven by a predetermined current (or voltage). As may be seen in FIG. 1*a* for a specific current through the electroluminescent material, both the voltage V and spectral shift $\Delta\lambda$ of a display are essentially exponentially dependent on the total drive time t of the pixel. An essentially linear relationship between the voltage shift $\Delta V$ and spectral shift $\Delta\lambda$ may be generated, as seen in FIG. 1*b*. This linear relationship is illustrated with the line LF, being the linear fit. Furthermore, this linear relationship is independent of the total drive time of the display, but is dependent upon the current. Consequently, by measuring one of the voltages across, or the current through, the display, while maintaining the other at a constant value, the wavelength shift may be obtained. Consequently, a color point correction factor may be applied to a data signal, being fed to a display, in order to compensate for ageing of the display, since ageing changes the mutual relationship between the current and voltage. Furthermore, such a color correction may be dealt with electronically, as will be described below.

When driving the display, the above-described display device may be color-corrected in two different ways.

In accordance with a first embodiment of the invention, as shown in FIG. 2, a data signal S is inputted to the driving means 7 via an input means 8. The data signal S is fed to signal-processing means 11 and also to the respective pixel/sub-pixel of the display via an output means 9, in order to display an image on said display device.

When manufacturing the display device, a "calibration" is made, in which the voltage $V_0$ across a sub-pixel is measured for a chosen current $I_s$ through the sub-pixel. The values of $V_0$ and $I_s$ may thereafter be stored in a memory in the device. This is done for each sub-pixel of the pixel. Furthermore, for each material that is used in the device, a compensation curve, such as the one shown in FIG. 1*b,* is generated by performing a wavelength shift/voltage change measurement as a function of time for a given constant current, as is shown in FIG. 1*a*. This measurement and the generation of the compensation curve need only to be made once for each material, and this compensation curve is a material characteristic. For most materials, the relationship between voltage shift ΔV and wavelength shift Δλ is linear, as is shown in FIG. 1*b* and previously explained. As is understood from FIG. 1*b,* the following relationship is obtained:

$$\Delta\lambda = k \cdot \Delta V$$

where Δλ is the obtained wavelength shift, k is a correction coefficient and ΔV is a voltage shift. In this embodiment, k is essentially a materials constant, as is evident from FIG. 1*b*. However, the correction coefficient could also be a function of the voltage across and/or the current through the display, i.e. k=k(V,I).

A minimal memory area may be used in order to store a look-up table, since it is sufficient to store only the slope value, or correction coefficient k of said curve. The value $V_0$ is corresponding to ΔV=0 in the compensation curve as shown in FIG. 1*b*.

With predetermined time intervals, such as an hour, or whenever the display is started, a corresponding current $I_s$ is fed through the display, wherein the voltage V across the display is measured by means of a voltage meter. The value of the measured voltage V is thereafter compared with the initial voltage value $V_0$ for that specific current through the display. The voltage shift ΔV may be obtained by:

$$\Delta V = |V - V_0|$$

When ΔV is known, Δv may easily be obtained by applying the correction coefficient stored in said look-up table. Thereafter, an appropriate correction factor may be applied on the data signal S, before it is fed to the display, wherein color correction is effected, by adjusting the voltage/current through the sub-pixels of a pixel so that the total color point of the pixel is unchanged. If the color point of a sub-pixel changes, it might be necessary to adjust also the voltage/current through the other sub-pixels of the same pixel.

In accordance with a second embodiment of this invention, the "calibration" is made by measuring the current $I_0$ for a determined voltage value, $V_s$. A corresponding compensation curve, as is shown in FIG. 1*b,* may be generated for the relationship between current and wavelength shift. The value $I_s$ is corresponding to ΔI=0 in the compensation curve.

With predetermined time intervals, such as an hour, or whenever the display is started, a corresponding value $V_s$ is applied across the display, wherein the current I through the display is measured by means of a current meter. The value of the measured current I is thereafter compared with the initial current value $I_0$ for that specific voltage across the display. The current shift ΔI may be obtained by:

$$\Delta I = |I - I_0|$$

When ΔI is known, Δλ may easily be obtained by applying the correction coefficient stored in said look-up table. Thereafter, an appropriate correction factor may be applied on the data signal S in the signal processing means 11, before it is fed to the display, wherein color correction is effected.

For both embodiments described above, it is also possible to relate the voltage/current value with a previously measured value of the same parameter instead of relating the measured voltage/current value with an initial value. Here a further memory for storing previously measured voltage/current value is needed. This may be done, for example, once in every frame.

Furthermore, it is possible to use materials not having a linear relationship between voltage/current shift and wavelength. However, in this case, a larger look-up table is needed in order to provide correction factors for a plurality of shift values.

By utilizing the above-described approach, it is possible to maintain a correct color balance during the entire lifetime of the display, by individually adjusting the emitted wavelength from the sub-pixels, and thereby generating a constant total color point of the pixel. This is achieved by providing the display with a driver in accordance with the invention, which comprises means for determining the voltage/ current shift of each emitter in a pixel and for determining the spectral shift of each emitter, and which comprises means for applying a correction factor to the driving signals for the red, green and blue emitter of the pixel in order to correct for the spectral shift of the emitters.

The present invention should not be considered as being limited to the above-described embodiment, but rather includes all possible variants within by the scope defined by the appended claims.

The invention has been described in connection with a display device, and more specifically with a full color display device. However, it should be noted that the invention is equally applicable to other technical devices, such as a monochrome display device, non-graphical displays or an organic electroluminescent diode for use in a backlight panel or the like.

Furthermore, even if the above-described device is a polyLED device, said color correction approach is equally applicable to other organic electroluminescent devices such as organic LED (OLED) devices.

It should also be noted that the above-described predetermined voltage $V_0$ and current $I_0$ may be different for different sub-pixels. Moreover, it is possible to drive a display device partly in the above-described voltage-measurement mode, and partly in the above-described current-measurement mode.

In summary, this invention relates to a method for color correction in an organic electroluminescent device, having at least one pixel, comprising an electro-luminescent material layer, which is sandwiched between a first and a second electrode, the pixel constituting at least a first and a second light-emitting element, wherein said method comprises the steps of: inputting a data signal comprising information to be displayed by said light-emitting elements, generating, in a correction means, a correction factor for each light-emitting element, said correction factor being based on a relationship between a color point wavelength shift ($\Delta\lambda$) and a measured shift in one of a voltage across at least one of said light-emitting elements at a certain current ($I_s$) and a current through at least one of said light-emitting elements, at a certain voltage ($V_s$), and outputting from said correction means said correction factor, to be applied on said data signal.

The invention also relates to a drive means implementing the above-described method.

It should be noted that the above-mentioned embodiments illustrate rather than limit the invention, and that those skilled in the art will be able to design many alternative embodiments without departing from the scope of the appended claims. In the claims, any reference signs placed between parentheses shall not be construed as limiting the claim. The word "comprising" does not exclude the presence of elements or steps other than those listed in a claim. The word "a" or "an" preceding an element does not exclude the presence of a plurality of such elements. The invention can be implemented by means of hardware comprising several distinct elements, and by means of a suitably programmed computer. In the device claim enumerating several means, several of these means can be embodied by one and the same item of hardware. The mere fact that certain measures are recited in mutually different dependent claims does not indicate that a combination of these measures cannot be used to advantage.

The invention claimed is:

1. A method for color correction in an organic electroluminescent device (1) having at least one pixel (6) comprising an electroluminescent material layer (5), which is sandwiched between a first and a second electrode (2, 3), the pixel constituting a first and a second light-emitting element (6R, 6G), wherein said method comprises the steps of:

inputting a data signal (S) comprising information to be displayed by said light-emitting elements (6R, 6G), generating a correction factor for each light-emitting element (6R, 6G), said correction factors being based on:

(i) a measured shift in a voltage (V) across a light-emitting element (6R, 6G) at a predetermined current ($I_s$) through said light-emitting element, and a relation between the measured shift in the voltage and a color point wavelength shift $\Delta\lambda$ of said light-emitting element, or (ii) a measured shift in a current (I) through a light-emitting element (6R, 6G) at a predetermined voltage ($V_s$) across said light-emitting element, and a relation between the measured shift in the current and a color point wavelength shift $\Delta\lambda$ of said light-emitting element, applying said correction factor to said data signal (S); and supplying the corrected data signal (S) to the light-emitting elements (6R, 6G).

2. A method as claimed in claim 1, wherein said correction means (10) comprise a look-up table containing pre-measured information regarding the relation between the voltage applied across a light-emitting element (6R or 6G), or current applied through said light-emitting element (6R or 6G), and the wavelength shift $\Delta\lambda$ of said light-emitting element.

3. A method as claimed in claim 1, further comprising the steps of feeding, with predetermined time intervals, one of said light-emitting elements (6R; 6G) with the predetermined current ($I_s$), measuring the voltage (V) over the light-emitting element (6R; 6G) as the predetermined current ($I_s$) is fed through the light-emitting element (6R; 6G), calculating a voltage shift $\Delta V$ between said measured voltage (V) and a previous voltage ($V_0$) for the predetermined current ($I_s$), and outputting a correction factor corresponding to a wavelength shift $\Delta\lambda$ of said light-emitting element (6R; 6G), based on said voltage shift $\Delta V$.

4. A method as claimed in claim 3, wherein the wavelength shift $\Delta\lambda$ for a light-emitting element (6R; 6G) is calculated by:

$$\Delta\lambda = k \cdot \Delta V,$$

where k is a correction coefficient and wherein k is pre-stored for each light-emitting element (6R; 6G) or for each type of light-emitting element.

5. A method as claimed in claim 3, wherein said previous voltage $V_0$ is an initial voltage across said light-emitting element (6R; 6G), measured during manufacture of the device (1).

6. A method as claimed in claim 3, wherein said previous voltage $V_0$ is a voltage across said light-emitting element (6R; 6G), measured previously during the drive of the device.

7. A method as claimed in claim 1, comprising the steps of feeding, with predetermined time intervals, one of said light-emitting elements (6R; 6G) with a predetermined voltage ($V_s$), measuring the current (I) through said light-emitting element (6R; 6G) as the predetermined voltage ($V_s$) is applied across the light-emitting element (6R; 6G), calculating a current shift $\Delta I$ between said measured current (I) and a previous current $I_O$, outputting a correction factor corresponding to a wavelength shift $\Delta\lambda$ of said light-emitting element (6R; 6G), based on said current shift $\Delta I$.

8. A method as claimed in claim 7, wherein the wavelength shift $\Delta\lambda$ for said light-emitting element (6R; 6G)is calculated by:

$$\Delta\lambda = k \cdot \Delta I$$

where k is a correction factor and wherein k is pre-stored in said correction means (10) for each light-emitting element (6R; 6G) or for each type of light-emitting element.

9. A method as claimed in claim 1, wherein said electroluminescent material layer (5) comprises a polymer light-emitting material, an organic light-emitting material, or a mixture of a polymer and an organic light-emitting material.

10. A method as claimed in claim 1, wherein said correction factor is arranged to provide a substantially constant total color point for the pixel, based on the light output from each of said light-emitting elements (6R, 6G).

11. A drive means (7) for an organic electroluminescent device (1), comprising a layer (5) of electroluminescent material which is sandwiched between a first and a second electrode pattern (2, 3), wherein said patterns define at least one pixel (6), comprising at least a first and a second light-emitting element (6R, 6G), said drive means (7) being connected to said electrodes (2, 3) and arranged to apply a current (I) through said electroluminescent material in order to achieve light emission from said material, said drive means (7) comprising:

an input connection (8) for inputting a data signal (S), comprising information to be displayed by each of said light-emitting elements (6R, 6G), a correction means (10) for applying a correction factor to said data signal (S), said correction factor being based on a relationship between a color point wavelength shift and a measured shift in one of a voltage (V) across at least one of said light-emitting elements (6R, 6G) and a current (I) through this light-emitting elements (6R, 6G), and an output means (9) for outputting said color-corrected data signal to said light-emitting elements (6R, 6G).

* * * * *